United States Patent [19]

Towns

[11] 4,008,834

[45] Feb. 22, 1977

[54] TIP SEAL FOR A DISPENSING VALVE

[76] Inventor: Edward J. Towns, Normandy Heights Road, Convent Station, N.J. 07961

[22] Filed: July 18, 1975

[21] Appl. No.: 597,247

Related U.S. Application Data

[63] Continuation-in-part of Ser. No. 426,351, Dec. 19, 1973, abandoned.

[52] U.S. Cl. ..... 222/402.23; 222/493; 222/513

[51] Int. Cl.[2] ..... B65D 83/00

[58] Field of Search ..... 222/402.21–402.24, 222/491–499, 501, 513, 524, 525

[56] References Cited

UNITED STATES PATENTS

| | | | |
|---|---|---|---|
| 3,076,583 | 2/1963 | Eberspacher | 222/493 |
| 3,357,604 | 12/1967 | Barker | 222/513 |
| 3,489,323 | 1/1970 | Hug | 222/402.16 |
| 3,920,165 | 11/1975 | Schultz | 222/402.23 |

FOREIGN PATENTS OR APPLICATIONS

| | | | |
|---|---|---|---|
| 425,943 | 3/1935 | United Kingdom | 222/493 |

*Primary Examiner*—Robert B. Reeves
*Assistant Examiner*—H. Grant Skaggs
*Attorney, Agent, or Firm*—Kenyon & Kenyon Reilly Carr & Chapin

[57] ABSTRACT

An improved type of tip seal for a dispensing arrangement used for dispensing viscous products and the like with the tip seal comprising essentially an inner stem attached to a body portion, an outer stem slidably mounted over the body portion and having an opening which mates with the tip of the inner stem to form the tip seal and a stretchable rubber member holding the outer stem in contact with the inner stem when no pressure is supplied inside the body but stretching in response to pressure to open the tip seal to permit dispensing of material.

23 Claims, 7 Drawing Figures

TIP SEAL FOR A DISPENSING VALVE

RELATED APPLICATIONS

This application is a continuation-in-part of application Ser. No. 426,351 filed Dec. 19, 1973 and now abandon.

BACKGROUND OF THE INVENTION

This invention relates to valves for dispensing viscous products contained in a can or container in general, and more particularly to such a valve which has a seat at its tip to prevent hardening of the material which is left within the valve stem after dispensing.

Aerosol containers are being used increasingly for the dispensing of viscous products like cheese, whipped cream and other food products along with materials such as toothpaste and glues. Typically, the type of valve mechanism used in these devices is one in which a dispensing nozzle mounted atop the can is tilted in order to open a valve mechanism to permit liquid to flow out through the nozzle. Such a valve is more practical for dispensing viscous liquids than valves typically used to dispense non-viscous liquid or powder products which valves are of a smaller size containing small ports and are operated through axial movement. Other types of material such as toothpaste and also cheeses and the like, are dispensed from collapsible tubes with the pressure for forcing the material out of the tube being applied by the user externally thereto in well known fashion. Typically, these types of dispensers are not fitted with a valve but with a screw-on cap. However, should the cap become misplaced, the material will then harden at the entrance of the tube, causing difficulties and waste of product. In aerosol containers having the type of dispensing valve described above, one of the major problems, particularly when dispensing viscous material, is that material can be left behind in the nozzle, which material tends to harden and block the passages therein. In addition, when dispensing food products, such hardening of the materials can make the product unappetizing in addition to making it unsanitary and possibly harmful. In view of this, various mechanisms have been developed to overcome this problem. In one of these disclosed in U.S. Pat. No. 3,506,165, a valve is shown wherein the sealing of the valve occurs at the tip of the nozzle. This arrangement prevents hardening within the nozzle. However, it has a number of disadvantages since sealing at the end of the nozzle is not as easily accomplished as sealing at the bottom. Another proposed solution to this problem is disclosed in U.S. Pat. No. 3,489,323. The valve therein includes a sliding outer member which permits rinsing to remove any material which is left behind.

Although these prior art valves have been somewhat successful, they do not completely solve the problem associated with dispensing this type of material, particularly due to problems associated with tip sealing. Furthermore, none of these prior art devices have dealt with the problems associated with dispensing toothpaste and the like from collapsable tubes. Thus, there is a need for a type of tip seal which may be used with both aerosol valve dispensers and furthermore, with collapsable tube dispensers which protects the product which remains within the valve nozzle or the tube exit portion.

SUMMARY OF THE INVENTION

The present invention provides a tip seal arrangement which may be used with both valved aerosol containers and with collapsable tube dispensers. In essence, the tip seal of the present invention comprises a body portion which is attached to the aerosol container or tube with which the tip seal is associated. Ridgedly attached to the body is a shaft-like inner stem. Slidably mounted over the body is an outer stem having an opening therein which matches the tip of the inner stem so that the outer stem may seat against the inner stem to provide the tip sealing. The final means involved are means for holding the outer stem in contact with the inner stem when the tip seal is not being operated. In the preferred embodiment, this comprises a stretchable rubber member which couples the outer stem and the body. The rubber has a reduced section which will permit it to stretch when pressure is admitted inside the body, which pressure will then force the outer stem away from the inner stem, permitting material to be dispensed. In a further embodiment of the invention, sealing between the inner and outer stems is obtained through a screw or snap type connection between the outer stem and the valve body.

The tip seal is shown in combination with an aerosol type valve, in which the primary sealing of the valve takes place within the container at the base of the nozzle.

Also illustrated is an improved embodiment of the tip seal for use with an aerosol valve container which permits dispensing of metered amounts.

BRIEF DESCRIPTION OF THE DRAWINGS

FIG. 1 is a cross-sectional view of an embodiment of the present invention which may be used with collapsable tubes and the like.

FIG. 2 is a perspective view of the dispensing valve of the present invention atop an aerosol can.

FIG. 3 is a cross-sectional view of a first embodiment of the present invention for use with an aerosol container.

FIGS. **6*a* and 6*b*** illustrate a tip for use in decorative dispensing.

DETAILED DESCRIPTION OF THE PREFERRED EMBODIMENT

Figures 1, 2, 3:
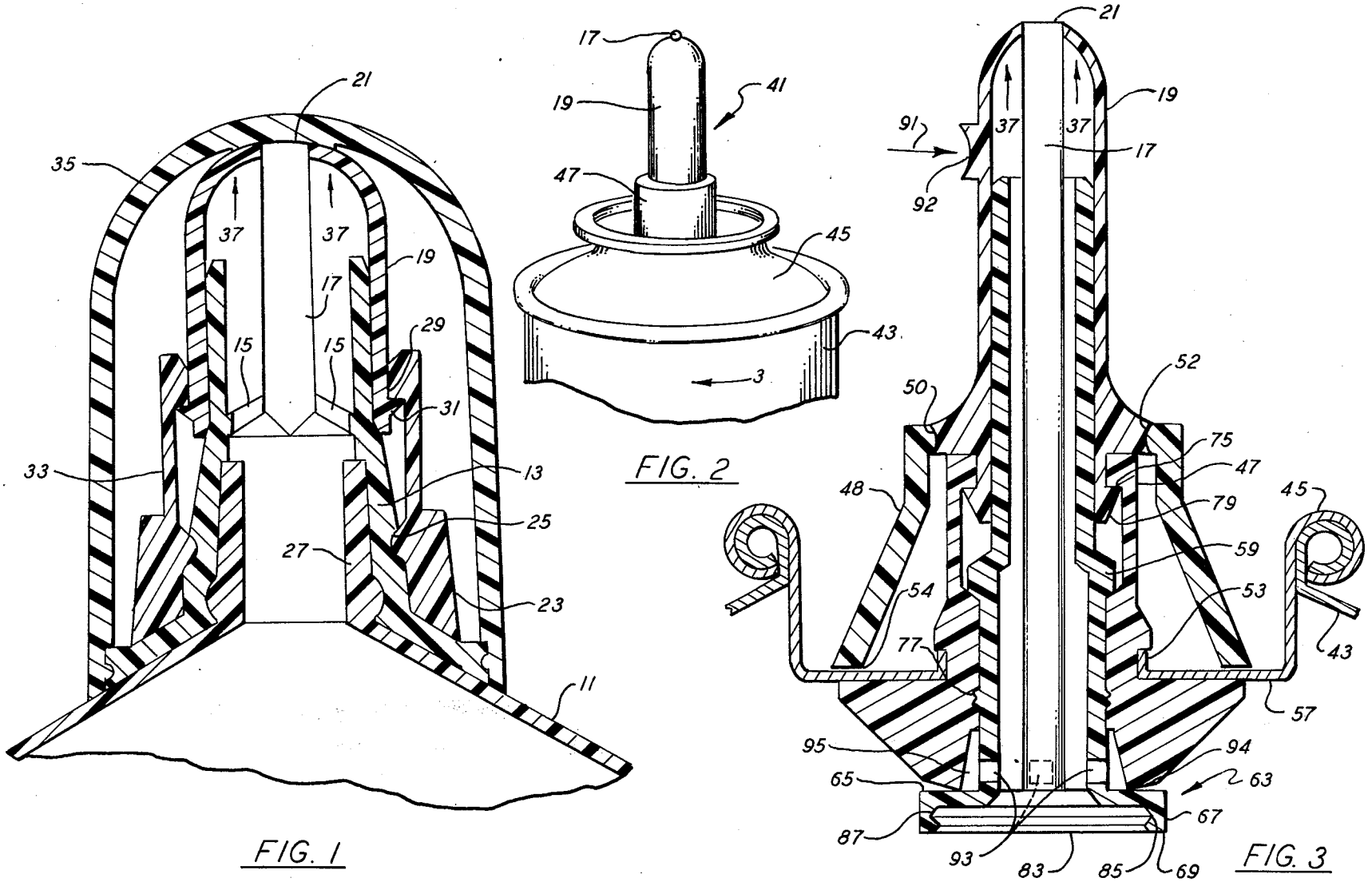

The principles of the present invention can best be illustrated by the embodiment of FIG. 1 which illustrates the tip seal of the present invention for use with a collapsable dispensing tube such as a toothpaste tube. Attached to the flexible metal tube 11 is a valve body portion 13. This is applied in conventional fashion in much the same way as plastic threads are presently placed on the ends of such tubes. Ridgedly attached to the body 13 by means of a plurality of struts 15 is an inner stem 17. It will be recognized that the body 13 and stem 17 along with the struts 15 can be molded in a single operation. The preferred material for these portions is a plastic such as polypropylene or the like, although in each case, parts can be made up of metal. Slidably mounted over the body 13 is an outer stem 19. Stem 19 contains a central hole 21 which is sized to fit over the end of the inner stem 17 to form a seal. As illustrated, the tip of stem 17 will preferably be tapered and the matching portion of stem 19 at the hole 21 similarly tapered to form a tight seal. When not being operated, the outer stem 19 is held tightly against the inner stem 17 by a rubber member 23. Member 23 is held onto the body 13 by means of projections 25 which snap into a recess 27 formed in the body 13. At the upper end, projections 29 on the rubber engage a circular projection 31 formed in the outer stem 19. The rubber member 23 has a section 33 of reduced diameter to permit stretching. A throwaway plastic cover 35 is provided which fits over the tip seal assembly and may be thrown away after the user purchases the product. In operation, when the user applies pressure to the flexible tube 11, this pressure is transmitted through the material to the top of the outer stem 19 with pressure being applied in the direction of the arrows 37. This pressure will cause the sections 33 of the rubber to elongate, permitting the material to be dispensed through the opening 21. As soon as the user stops applying pressure, the rubber member 23 will pull the outer stem 19 down against the inner stem 17, sealing off the tip. As noted above, this arrangement is particularly useful for dispensing toothpaste and the like, and avoids the common problems associated with clogging of the tube outlet when the cap is misplaced or lost.

FIG. 2 is a perspective view of an arrangement such as that shown on FIG. 1 for use with an aerosol container. Shown is the valve indicated generally as 41 mounted atop a conventional aerosol can 43. The valve or nozzle assembly 41 includes a mounting cup 45 in which the valve parts are held. Visible on FIG. 2 are the tip of the inner stem 17, the outer stem 19 and a rubber grommet 47 which takes the place of the rubber member 33 of FIG. 1. The arrangement may more clearly be seen on FIG. 3. From FIG. 3, the mounting cup 45 which is crimped to the can 43 is seen to be a cylindrical cup shaped member having an annular opening in its center. At this annular opening, an annular flange 53 is provided. The rubber grommet 47 is forced into the opening formed by the flange 23 and seals against the flange 53 and the bottom 57 of the mounting cup 45. The valve body 59 is fitted into the inside of the grommet. Body 57 comprises an upper hollow cylindrical section having a passage therethrough, with an enlarged bottom portion 63 in the form of the circular disk 65 having a cylindrical depending flange 67 to form a cylindrical recess in its bottom. Body 59 engages projections 71 of the grommet to maintain the body properly axially positioned. Preferably, body 59 will be made of stiff ABS styrene.

Placed over the body 59 is an outer stem 19 preferably of polypropylene. This stem is a generally hollow cylindrical member with the top portion of the stem rounded. A discharge opening 21 is formed in the top of the outer stem 19. A projection 73 on the outside of the outer stem 19 engages projections 75 on grommet 47.

An inner stem comprising a solid cylindrical member 17 having a disk shaped member 83 at its base is snapped into the recess in the bottom of the body 59. The disk shaped portion is made to have a circular projection 85 which matches a recess 87 on the inside of the flange 67. The upper end of the solid cylindrical member 17 forms a circular top section 81 which fills the hole 21. The body 29 has one or more ports 93 near its base to form a passage between the outside of the body and the inner cylindrical recess. Although shown with the stem 17 filling the hole 21 without any tapering, it is preferred that tapering such as that shown on FIG. 1 above and that to be described in connection with FIG. 4 below, be used to ensure good sealing. Furthermore, the manner in which the disk 83 is tapered at the point where it engages a similar tapered edge on the cylindrical member 65 should be noted. This ensures a good seal between the inner stem 17 and the body 59.

When in an non-operated condition, as shown, pressure within the can holds the upper surface of the disk portion 65 tightly against the rubber grommet 47 sealing the valve and preventing any material from being discharged. At the same time the seal between the top of the inner stem 17 and the outer stem 19 seals off any material left within the cylindrical recesses of the inner and outer stems preventing contamination and drying out thereof.

In operation, the outer stem 19 is pressed radially outward for example, in the direction of arrow 91 using finger hold 92. This will result in the seal between the top of the disk 65 and the grommet 47 being broken, for example, at point 94. Material from the can will flow into the space 95 and thence through the ports 93 into the inner portion of the body. At the same time, the pressure on the outer stem 19 as it is pushed radially outward will have a component along the stem axis which will tend to push the outer stem upward, thereby breaking the seal between inner stem 17 and the outer stem 91 permitting the material to flow out through the opening 21. This will be aided by the material under pressure pushing against the outer stem 19 in the direction of arrows 37 in the manner described above in connection with FIG. 1. After dispensing is completed, the valve is then returned to the position shown with the operator insuring that the outer stem is all the way down. If desired, the tip at this point may be cleaned or washed.

Also shown on FIG. 3 is an optional cone 48 which greatly reduces the force which must be applied in the direction of arrow 91. The cone 48, preferably of plastic, has a projection 50 at its top which snaps into a groove 52 in outer stem 19. Its base 54 is on or near the bottom 57 of the mounting cup. During operation the base acts as a fulcrum to cause a more positive opening of tipseal opening of the valve due to the increased lever arm. In addition cone 48 presses against the top of grommet 47 to maintain it in engagement with outer stem 19.

Figure 4:
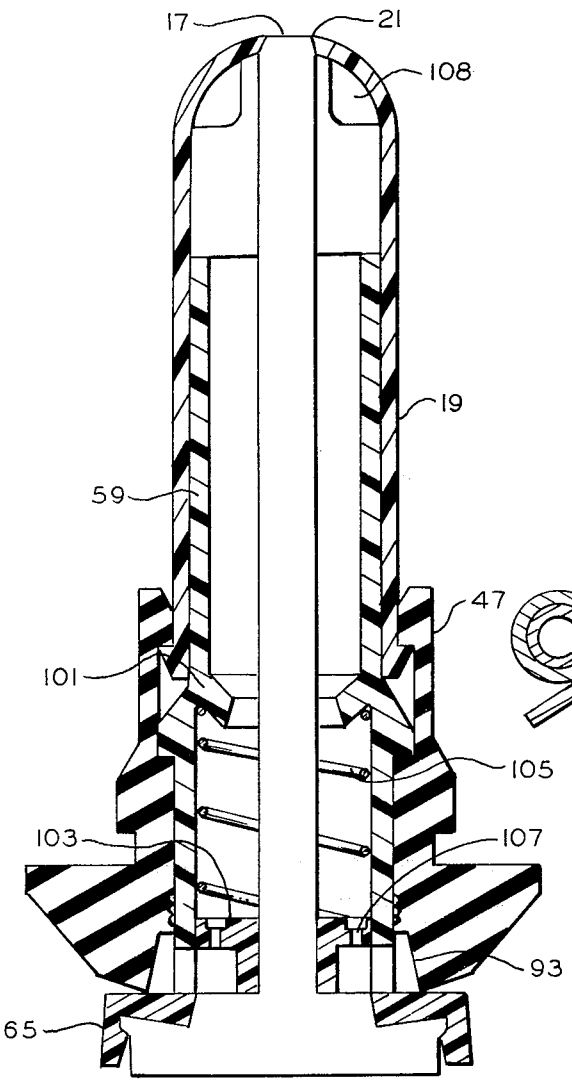
FIG. 4 is a similar view of a modified embodiment which permits dispensing metered amounts of material.

A modification of the embodiment of FIG. 3 to provide a metered dispensing valve is shown on FIG. 4. Identical parts are given identical reference numerals and will not be reexplained. In this embodiment, the inner stem 17 and outer stem 19 are exactly the same as those of FIG. 3 as is the rubber grommet 47. The body 59 is the same with one exception. It contains inner projections 101. In addition, a piston 103 is slidably mounted over the inner stem 17 and is biased in a downward direction by a spring 105 which is held in place by the recesses 101. As illustrated, the piston 103 comprises an essentially cylindrical member and contains a plurality of small ports 107 through which material can flow in a manner to be described below. After having been used, the inside of the nozzle between the body 59 and outer stem 19, an inner stem 17 will be filled with material. The tip seal between the inner stem 17 and the outer stem 19 at the opening 21 will seal off this material from air to avoid hardening or contamination. When the nozzle is tilted in the manner described above, breaking the seal between the disk 65 and the rubber grommet, material will enter through the ports 93 under pressure, acting against the bottom 109 of the piston 103. This will force the piston up against the force of spring 105. Piston 103 will continue to move upward until it stops at the downward projecting portions 101. These portions 101 also act to seal off ports 107. Thus, a metered amount of material will be dispensed from the tip opening 21. This material will essentially be the volume of material stored over the distance indicated as L. on the figure. Small additional amounts of material will be dispensed because of flow through the ports 107. This can either be precomputed or neglected, depending on how accurately the dose must be dispensed. Adjustment of the distance L by the positioning of the projections 101 or by the sizing of the piston 103 permits dispensing different doses. After operation, the piston 103 will be fully up with the spaces both above and below it filled with material. After the pressure is released by closing off the opening between the disk 65 and the grommet 47, piston 103 will gradually return to the position shown under the force of the spring 105 with material slowly passing through the ports 107. It will then be ready for the next dispensing cycle. Also shown on FIG. 4 are flutes 108 which may be included to keep inner stem 17 aligned when dispensing. Otherwise, it will rest to the side causing a non-uniform flow of material.

Figure 5:
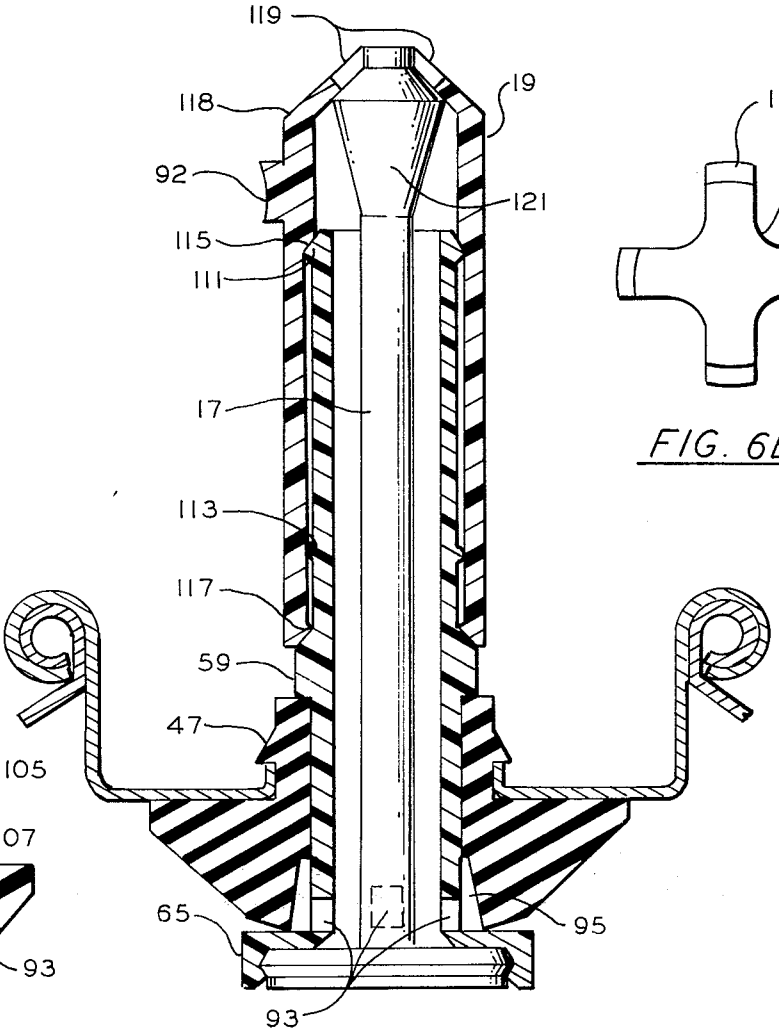
FIG. 5 is a similar view of a further embodiment of the present invention which may be used for dispensing from an aerosol container.

An embodiment which uses means other than a stretchable rubber member to hold the outer stem in position is illustrated on FIG. 5. Also illustrated thereon, is a different type of tip sealing. Again, identical parts are given identical reference numerals. The primary differences in this embodiment are the shaping at the tip seal, a change in the grommet and thus, in the way of maintaining the outer stem 19 seated against the inner stem 17. Insertion of the base 83 of the inner stem into the bottom portion 65 of the body is exactly as described above, as are the ports 93 formed therein and the manner of sealing between member 65 and the grommet 47. The grommet 47 now is shorter and is used only for sealing the body 59 to the mounting cup 45 and for sealing of the base portion 65 thereof inside the can. The body has sloped projections 111 at its upper end and projections 113 on its sides. The outer stem 19 has a sloped portion 115 which mates with the projection 111 when in the position shown and a bottom projection 117 which limits the upward travel of the outer stem 19. The top of the outer stem 19 is formed as a truncated cone with a hole in the center and may also have slits 119 formed therein to dispense the viscous material in a decorative manner. The top 121 of the inner stem 17 is flared to seat against the slanting sides of the truncated cone 118. The outer stem 19 is sized so that the projections 117 will hold tightly against the body 59 holding the tip seal in a seated condition. Alternatively, the projections 113 may be made in the form of threads with the projection 117 being a matching thread so that the outer stem 19 can be positively screwed up and down. Operation is similar to that described above in connection with FIGS. 3 and 4 with pressure being applied to the finger hold 92 unseating the inner seal which is formed between the member 65 and grommet 47 to permit material to flow under pressure forcing the outer stem 19 upward. Again, a component of force will aid in moving the outer stem upward to allow dispensing of the material. After use, the user will then firmly press the outer stem down to maintain the seal. If a screw type coupling is used, then the outer stem is first unscrewed and then the material dispensed in the manner described above.

Figure 6A:
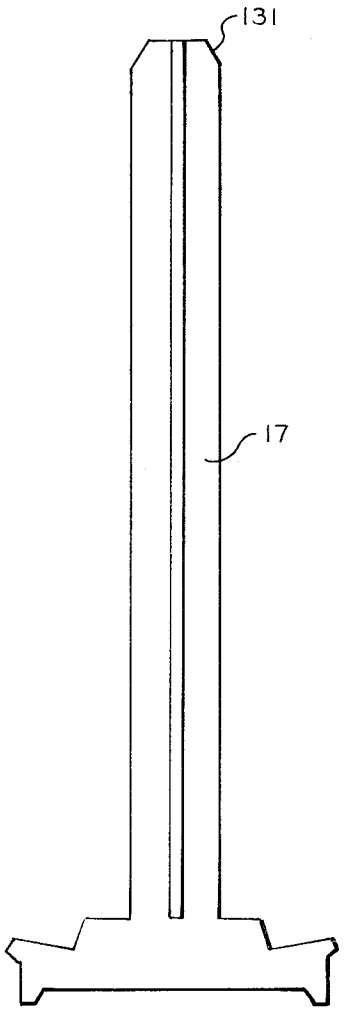
Figure 6B:
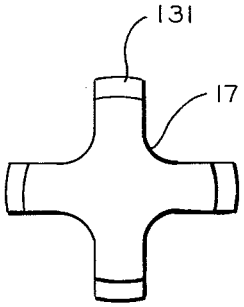

FIG. 6 illustrates a type of inner stem 17 which can be used for the decorative dispensing of cheese products and the like. This may be used with the embodiments of FIGS. 3 or 4. FIG. 6*a* illustrates an elevation view of the stem with FIG. 6*b* showing a plan view. Construction is similar to that described above, except that the stem is now made cross shaped rather than solid. Matching holes such as the hole 21 will be formed in the outer stem 19 with bevels 131 as shown so that a good seal is maintained. The cross shape holes and stem will cause the product to be dispensed in a decorative manner, in well known fashion.

Various materials which can be used in making the present invention have been noted herein. In general terms, any material having the needed rigidity and compatible with the material to be dispensed may be used. This includes rigid plastics such as nylon, polypropylene, polystyrene etc., as well as metals.

A container with a tip seal such as that of FIG. 3 was constructed and filled with Elmer's glue and pressurized. After dispensing glue, the container was allowed to sit unoperated for a prolonged period. After scraping away a small film of hardened glue left on the tip using the fingernal, the dispenser was satisfactorily operated, thus demonstrating the effectiveness of the tip seal.

Thus, an improved tip seal for containers dispensing viscous products and the like has been shown. Although specific embodiments have been illustrated and described, it will be obvious to those skilled in the art that various modifications may be made without departing from the spirit of the invention which is intended to be limited solely by the appended claims.

We claim:

1. A tip seal for a dispensing container comprising:

a. a body having a hollow central portion with means in the bottom part of said hollow central portion for engaging the outlet of a container;

b. an inner elongated stem rigidly coupled to said body and extending at least partially within said central portion and projecting out of said body;

c. an outer stem slidably mounted over the upper portion of said body, said outer stem having an opening matching the end of said inner stem; and d. a stretchable cylindrical member engaging the outside of the bottom portion of said body and the outside of said outer stem, said stretchable member having a stretchable portion of reduced diameter between its point of attachment with said body and its point of attachment with said outer stem, holding said outer stem in a position where its opening is covered by the end of said inner stem when said container is in a non-dispensing state and permitting separation of said outer and inner stems when dispensing through the action of pressure on the inside of said outer stem stretching said portions of reduced diameter to unseat said inner stem from said outer stem.

2. The invention according to claim 1 wherein said stretchable means are made of rubber.

3. The invention according to claim 1 wherein the end of said inner stem and said openings are bevelled so as to form a tight seal therebetween when in the unoperated position.

4. The invention according to claim 1 wherein said tip seal is used in combination with a collapsable metal tube and wherein said body is fitted over the dispensing opening in said tube, whereby the application of pressure to said tube by a user will force material under pressure inside said valve body resulting in pressure against said outer stem causing said outer stem to become unseated from said inner stem and resulting in material being dispensed.

5. The invention according to claim 4 wherein said inner stem is attached to said body with a plurality of struts extending from the internal surface of said body to the circumference of said inner stem.

6. The invention according to claim 5 wherein said body and inner stem are made of a plastic material and wherein said body, inner stem, and struts, are in one intergral piece.

7. A tip seal for a dispensing container comprising:

a. a body having a hollow central portion adapted to be in communication with material from the dispensing container;

b. an inner elongated stem rigidly coupled to said body and extending at least partially within said central portion and projecting out of said body;

c. an outer stem slidably mounted over said body, said outer stem having an opening matching the end of said inner stem;

d. a mounting cup having a flanged annular opening in its center;

e. a stretchable grommet having a central recess inserted in the flanged annular recess of said mounting cup in a sealing manner;

f. said body inserted through the central recess of said grommet, said body having at least one port through its wall and having a disc shaped base;

g. said grommet engaging said outer stem coupling it to said body, said grommet having a stretchable portion of reduced diameter between the point of attachment with said outer stem and said body;

h. said inner stem comprising an elongated member of a diameter less than the inner diameter of said hollow cylindrical portion extending through the center of said body and secured to the base thereof; and i. whereby when said mounting cup is attached to an aerosol container and when said body is in an upright position, the base of said body will seal against the said rubber grommet to form the primary sealing valve.

8. The invention according to claim 7 and further including a cone having an opening in its top slid over said outer stem, engaging means on said cone and said outer stem comprising a recess on one and a projection on the other for holding said cone and outer stem fixed together, the base of said cone extending to at least near the base of said mounting cup to act as a fulcrum point for tilting of said outer stem.

9. The invention according to claim 7 wherein said base of said body has a cylindrical recess in the bottom thereof and said inner stem is mounted on a disk shaped base which is secured in said recess.

10. The invention according to claim 9 and further including a bevelled portion on the inside of said body at said base and a matching bevelled portion at the base of said inner stem whereby effective sealing therebetween will take place.

11. The invention according to claim 10 and further including:

a. a piston slidably mounted over the elongated cylindrical portion of said inner stem containing a plurality of small axial ports in its periphery;

b. a downwardly pointing annular projection on the inside of said body; and c. a spring between said projection and said piston biasing said piston in a downward direction.

12. The invention according to claim 11 wherein the width of said annular projection is greater than the diameter of said small axial ports whereby said annular projection will block off said ports when said piston is pushed upward into contact therewith.

13. A dispenser valve assembly for dispensing viscous liquids comprising:

a. a mounting cup having a flanged annular opening in its center;

b. a stretchable grommet having a central recess inserted in the flanged annular opening of said mounting cup in a sealing manner;

c. a body inserted through the central recess in said grommet, said body comprising an essentially hollow cylindrical portion containing at least one port through its wall on a disk shaped base, said base being in sealing abutment with said grommet;

d. an inner stem comprising an elongated cylindrical member of a diameter less than the inner diameter of said hollow cylindrical portion extending through the center of said body and secured to the base thereof;

e. an outer stem slidably mounted over and surrounding the upper portion of said body and having an opening in the top thereof for discharge of said viscous liquid, the sizing of said outer stem and said inner stem being such so that in an unoperated condition said inner stem seals off said opening; and f. an extension of said grommet having an internal projection and an external projection on said outer stem for axially restraining said outer stem for limited motion with respect to said body.

14. The invention according to claim 13 wherein said base of said body has a cylindrical recess in the bottom thereof and said inner stem is mounted on a disk shaped base which is secured in said recess.

15. The invention according to claim 14 wherein said inner stem is secured in said recess using an internal annular recess and a matching circular projection, one being formed on the inside of said recess and the other on said inner stem base, whereby said base may be snapped into said recess.

16. The invention according to claim 13 and further including a cone having an opening in its top slid over said outer stem, engaging means on said cone and said outer stem comprising a recess on one and a projection on the other for holding said cone and outer stem fixed together, the base of said cone extending to at least near the base of said mounting cup to act as a fulcrum point for tilting of said outer stem.

17. The invention according to claim 16 wherein the inside of said cone abuts the top of said grommet maintaining it in engagement with said outer stem.

18. The invention according to claim 13 wherein the top portion of said outer stem converges and wherein the top portion of said inner stem is flared, the top portion of said inner stem abuting against the converging portion of said outer stem when said valve is in an unoperated condition.

19. The invention according to claim 18 wherein said converging portion comprises a truncated cone.

20. The invention according to claim 18 and further including a plurality of slots formed in the portion of said outer stem which converges.

21. The invention according to claim 13 wherein the top of said outer stem is essentially hemispherical and contains a central hole.

22. The invention according to claim 21 wherein said inner stem projects through the opening in said outer stem when said valve is in an unoperated condition.

23. The invention according to claim 13 wherein said inner stem is made of polypropylene, said body of ABS styrene and said outer stem of polypropylene.

* * * * *